US007634411B2

(12) United States Patent
Grubba

(10) Patent No.: US 7,634,411 B2
(45) Date of Patent: Dec. 15, 2009

(54) SYNCHRONIZED EXTERNALLY GENERATED SOUND EFFECTS FOR MODEL TRAINS

(76) Inventor: Robert A. Grubba, 290 Golden Saddle La., Ormond Beach, FL (US) 32174

( * ) Notice: Subject to any disclaimer, the term of this patent is extended or adjusted under 35 U.S.C. 154(b) by 603 days.

(21) Appl. No.: 11/486,868

(22) Filed: Jul. 14, 2006

(65) Prior Publication Data

US 2008/0015862 A1 Jan. 17, 2008

(51) Int. Cl.
*G10L 21/00* (2006.01)

(52) U.S. Cl. ..... 704/270

(58) Field of Classification Search ..... 704/270
See application file for complete search history.

(56) References Cited

U.S. PATENT DOCUMENTS 5,896,017 A * 4/1999 Severson et al. ..... 312/280
6,485,347 B1 11/2002 Grubba et al.
6,655,640 B2 12/2003 Wolf et al.
6,765,356 B1 7/2004 Denen et al.
7,164,368 B1 * 1/2007 Ireland ..... 341/34
7,211,976 B2 * 5/2007 Denen et al. ..... 318/286
7,307,394 B1 * 12/2007 Denen et al. ..... 318/286
7,471,649 B1 * 12/2008 Kovach et al. ..... 370/278

* cited by examiner

*Primary Examiner*—Susan McFadden
(74) *Attorney, Agent, or Firm*—J. Wiley Horton

(57) ABSTRACT

A system for generating realistic train sounds which are synchronized with the motion of a model train. A sensor is placed aboard the model train to sense the position of desired components, such as the driving pistons of a model steam engine. Preferably, sound data is gathered and transmitted as a radio frequency signal from the model train. The radio frequency signal is received by an external receiver/amplifier. This component amplifies the synchronized sounds and plays them through a subwoofer which is capable of producing deep and resonant sound.

15 Claims, 10 Drawing Sheets

SYNCHRONIZED EXTERNALLY GENERATED SOUND EFFECTS FOR MODEL TRAINS

BACKGROUND OF THE INVENTION

1. Field of the Invention

This invention relates to the field of model trains. More specifically, the invention comprises a system for creating externally generated sound effects which are synchronized with the motion of a model train.

2. Description of the Related Art

Hobbyists and serious collectors have enjoyed model trains for many decades. The high end of this marketplace places a premium on realism. The models are highly detailed and historically accurate. They may include inertia-simulating motion control, realistic sound effects, and smoke effects. The customer generally desires a model train which behaves as closely as possible to its full-sized counterpart.

Numerous inventions have added to the realism of model trains. U.S. Pat. No. 6,765,356 to Denen, Young, Moreau, Pierson, and Grubba (2004) provides a good explanation of motor control, motor position sensing, motor speed sensing, and sound effects. U.S. Pat. No. 6,765,356 is hereby incorporated by reference.

U.S. Pat. No. 6,485,347 to Grubba and Morrison (2002) provides a good explanation of smoke generating hardware and control techniques. U.S. Pat. No. 6,485,347 is also incorporated herein by reference.

U.S. Reissue Pat. No. RE38,660 to Novosel, Boles, and Fleszewski (2004) provides a good explanation of digital sound processing using a microprocessor and memory means which travel along with the model train. That patent describes the use of a small speaker contained within a model locomotive to generate the sounds. U.S. Pat. No. RE38,660 is therefore also incorporated by reference.

This disclosure uses the term "train sounds" to generally describe the sounds emitted by an actual train in operation. These would include hissing steam, squealing brakes, "chuffing" steam pistons, and the rumble of a large diesel engine. Those skilled in the art will know that most model trains are fairly compact. The inherent size limitation has traditionally limited the realism of the sound produced by a model train, since only a small speaker will fit in the available space. Actual trains are, of course, massive. They produce many low-frequency sounds having substantial amplitude. A system capable of reproducing the full spectrum of actual train noises would therefore be more realistic.

BRIEF SUMMARY OF THE PRESENT INVENTION

The present invention comprises a system for generating realistic train sounds which are synchronized with the motion of a model train. A sensor is placed aboard the model train to sense the position of desired components, such as the driving pistons of a model steam engine. Preferably, sound data is gathered and transmitted as a radio frequency signal from the model train.

The radio frequency signal is received by an external receiver/amplifier. This component uses the signal to synchronize prerecorded train sounds with the motion of the model locomotive. The synchronized sounds are then amplified and played through a subwoofer which is capable of producing deep and resonant sound.

Other speakers may be used to create higher-pitched sounds. it is also possible to split the signal so that relatively high-pitched sounds are played by a small speaker aboard the model locomotive and relatively low-pitched sounds are played through the external sub-woofer.

The synchronization hardware can be used to synchronize other features, such as smoke generating hardware. In such an embodiment, the external train sound effects are synchronized with the train's motion and the puffing of the smoke (in the case of a model steam engine) or the volume of the continuous smoke (in the case of a model diesel engine).

REFERENCE NUMERALS IN THE DRAWINGS

| | | | |
|---|---|---|---|
| 10 | model steam locomotive | 12 | body |
| 14 | cylinder | 16 | valving mechanisms |
| 18 | main rod | 20 | side rod |
| 22 | driving wheel | 24 | chassis |
| 26 | motor | 28 | gearbox |
| 30 | model diesel locomotive | 32 | body |
| 34 | chassis | 36 | motor |
| 38 | driving wheel assembly | 40 | axle |
| 42 | cam | 44 | contact switch |
| 46 | insulated strip | 48 | brush |
| 50 | sensing disk | 52 | opto coupler |
| 54 | trigger hole | 56 | Hall effect sensor |
| 58 | magnetic disk | 60 | notch |
| 62 | zero notch | 64 | cross head |
| 66 | magnet | 68 | RF transmitter |
| 70 | high frequency speaker | 72 | receiver/amplifier |
| 74 | subwoofer | 76 | receiver |
| 78 | low-pass filter | 80 | power amplifier |
| 82 | timing signal | 84 | processor |
| 86 | sound memory | 88 | frequency splitter |
| 90 | mod range speaker | 92 | tweeter |
| 94 | fan motor | 96 | fan |
| 98 | wick | 100 | heating element |

-continued

| | | | |
|---|---|---|---|
| 102 | exhaust | 104 | piston rod |
| 106 | tracks | | |

DETAILED DESCRIPTION OF THE INVENTION

The present invention produces realistic train effects which are synchronized with the motion of a model train. In order to understand the operation of the device, it is important to have a basic understanding of the model trains themselves.

Those skilled in the art will know that there are hundreds of different types of model trains in existence, using many different mechanisms. The following presents two exemplary types, though it will be understood that this is a very small sample of the existing hardware. The inventive devices could be applied to virtually any type of model train.

Figure 1:
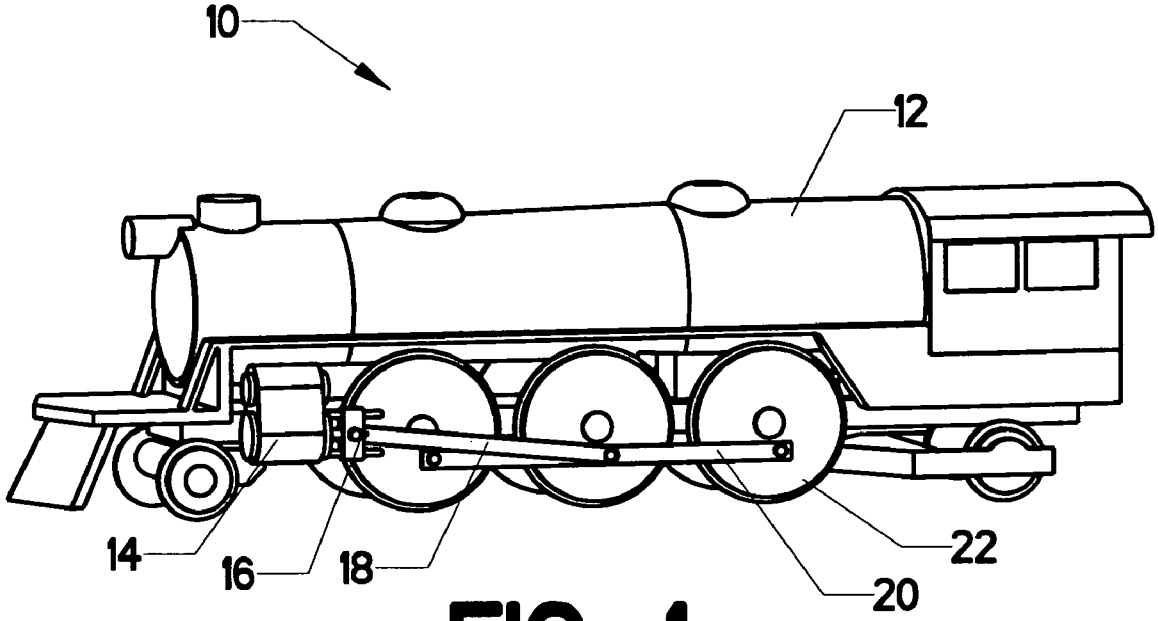
FIG. 1 (PRIOR ART)
FIG. 1 is a perspective view, showing a model steam locomotive.

FIG. 1 shows model steam locomotive 10. It includes a body 12, which replicates the features of a real locomotive in miniature. Many components of a model train are only present for appearance. They do not actually function. However, some components must actually function in order to maintain the model's realism. In the case of a steam engine, this fact means that the driving wheels and associated hardware must move in a realistic fashion.

Six driving wheels 22 are present for the model locomotive shown, with three driving wheels being located on each side (Other locomotive types have different numbers of driving wheels, such as 4, 18, 10, 12, or more). For a locomotive having six driving wheels, a side rod 20 links the three driving wheels on each side together. Main rod 18 links cylinder 14 to side rod 20. In an actual steam train, the piston would drive the main rod and ultimately the driving wheels. In the case of the model train, however, the driving wheels are typically driven by an electric motor and the side and main rods are driven by the driving wheels. Valving mechanisms 16 (which can assume many forms) are also driven by the main rod so that they move realistically. The depiction omits additional rods and linkages in the interest of visual clarity. Many model steam engines replicate these linkages—such as Walschaert's valve gear—in great detail.

Figure 2:
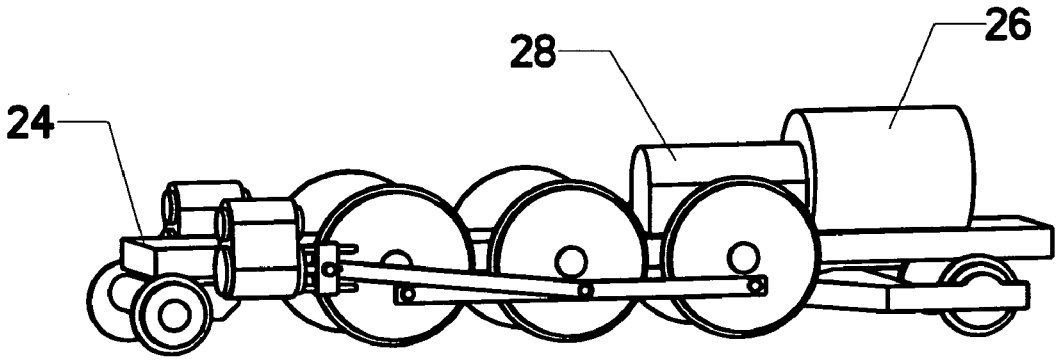
FIG. 2 (PRIOR ART)
FIG. 2 is a perspective view, showing the chassis of the model steam locomotive.

FIG. 2 shows the model steam locomotive with body 12 removed. Chassis 24 is revealed. Motor 26 drives gearbox 28, which in turn provides power to the three axles between the six driving wheels 22. Electrical power for the motor is usually obtained from the track itself. The motor may be wired directly to the track, or there may be an intervening control system which controls the motor.

Synchronization of sounds for a model steam train are particularly important, since actual steam trains make a rhythmic "chuffing" sound as the pistons cycle. Thus, in order to synchronize the sounds, it is important to know the position (and preferably the speed) of the driving components such as the main rod, side rod, and valving mechanisms.

Figure 3:
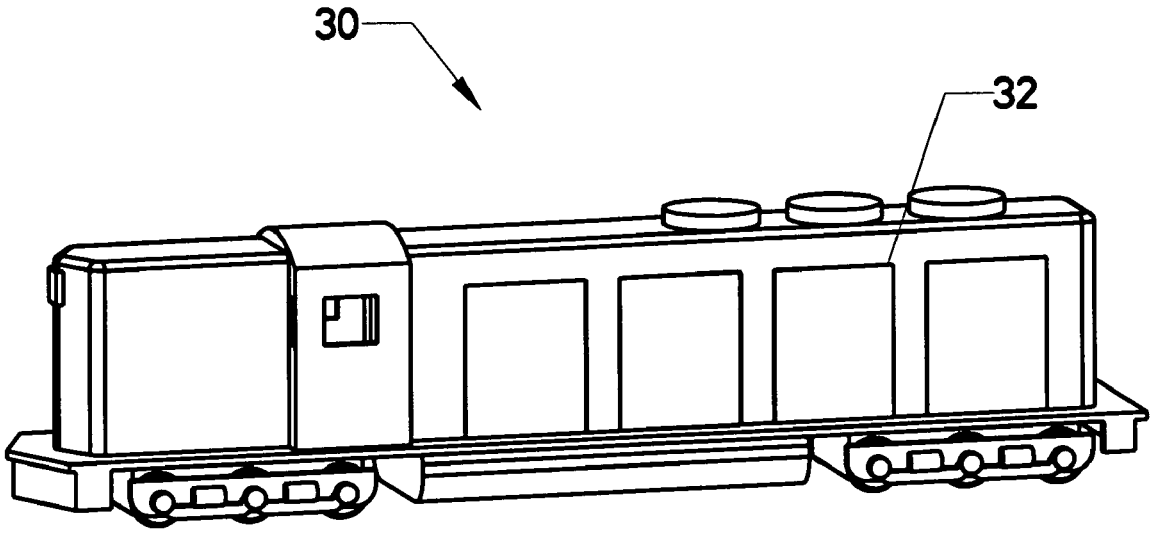
FIG. 3 (PRIOR ART)
FIG. 3 is a perspective view, showing a model diesel locomotive.
Figure 4:
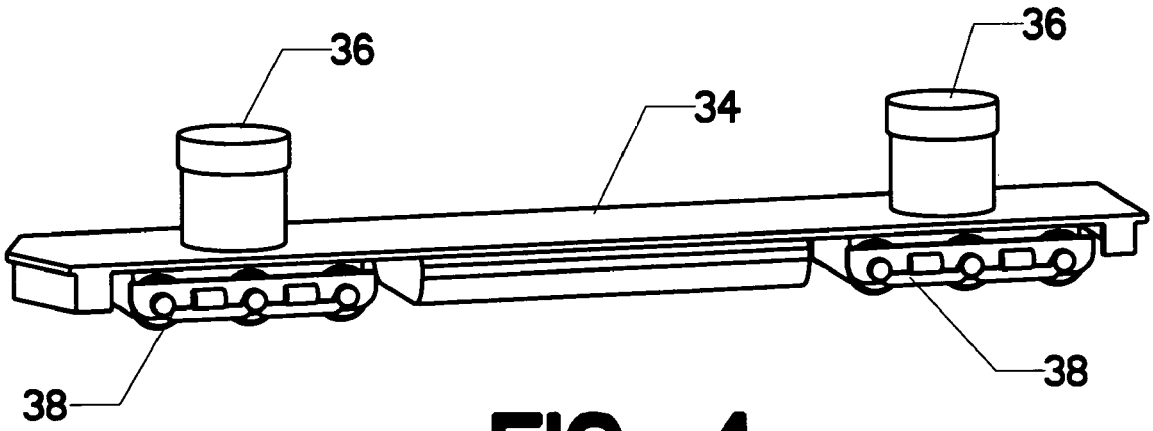
FIG. 4 (PRIOR ART)
FIG. 4 is a perspective view, showing the chassis of the model diesel locomotive.

FIG. 3 shows a representative model diesel locomotive 30. Body 32 presents an externally accurate appearance. FIG. 4 shows the same model locomotive with the body removed. Chassis 34 mounts two driving wheel assemblies 38, each of which are pivoted with respect to the chassis. For the particular version shown, each driving wheel assembly is powered by its own motor 36. The two motors may be powered directly by track voltage, or there may be an intervening control component actually on board the model train. Those skilled in the art will know that complex circuit boards are now often included in the model train. For a detailed explanation of the operation of motor control circuitry, the reader is referred to U.S. Pat. No. 6,765,356 to Denen et al., which was previously incorporated by reference.

For a diesel model, there are no external moving components like the main rod or side rod for the steam model. However, synchronization with movement is still important. Actual diesel trains make certain sounds when they are just starting, accelerating under load, stopping, etc. It is therefore generally sufficient to know the current speed and acceleration of the model diesel locomotive 30. A variety of sensors can provide such information.

Figures 5, 6, 7:
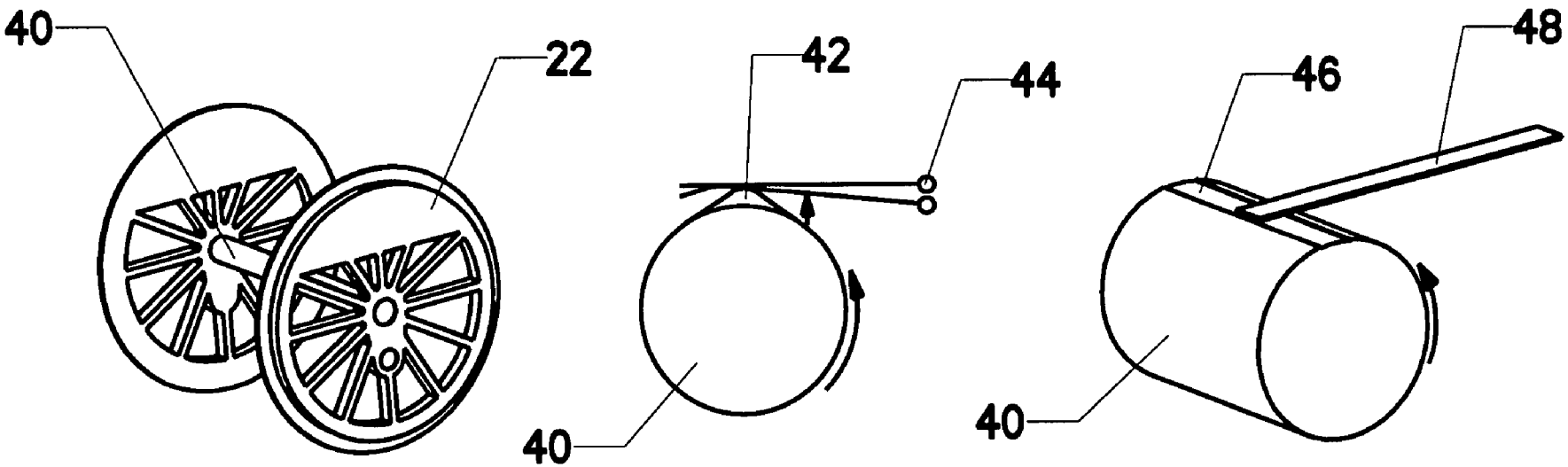
FIG. 7 (PRIOR ART)
FIG. 6 (PRIOR ART)
FIG. 5 (PRIOR ART)
FIG. 5 is a perspective view, showing an axle.
FIG. 6 is an elevation view, showing the placement of a cam and contact switch on an axle.
FIG. 7 is a partial perspective view, showing the placement of a brush and insulated strip on an axle.

FIGS. 5-10 provide examples of the types of sensors which can be employed in the present invention. FIG. 5 shows an axle assembly from the steam locomotive model. It includes a pair of driving wheels 22 linked by an axle 40. Most diesel models have similar axles and wheels, although the driving wheels are smaller.

It is possible to place a timing cam on the axle itself. FIG. 6 shows such an embodiment. Cam 42 is added to axle 40. As axle 40 rotates, cam 42 closes a simple contact switch 44 in order to "make" an electrical circuit. The reader will therefore appreciate that the arrangement shown in FIG. 6 can supply an electrical pulse once for every revolution of the axle.

Of course, those skilled in the art will know that steam trains typically make a "chuff" sound for every 90 degrees of axle rotation. Four cams could be provided in order to create four pulses per revolution. Other means could be used to provide the timing of the second, third, and fourth "chuffs" for each axle revolution.

Other features can be placed on an axle to provide the synchronized signal. FIG. 7 shows an embodiment where an insulated strip 46 has been added. An electrical brush 48 (such as is found in the commutator of an electric motor) makes contact with axle 40 as the axle rotates. The brush completes an electrical circuit, but the circuit is interrupted each time the insulated strip passes. The insulated strip thereby creates a timing signal.

For most model trains, the driving electric motor is directly linked to the wheels. Thus, if one can measure the position and speed of the motor, one can accurately obtain information regarding the position of other components.

Figure 8:
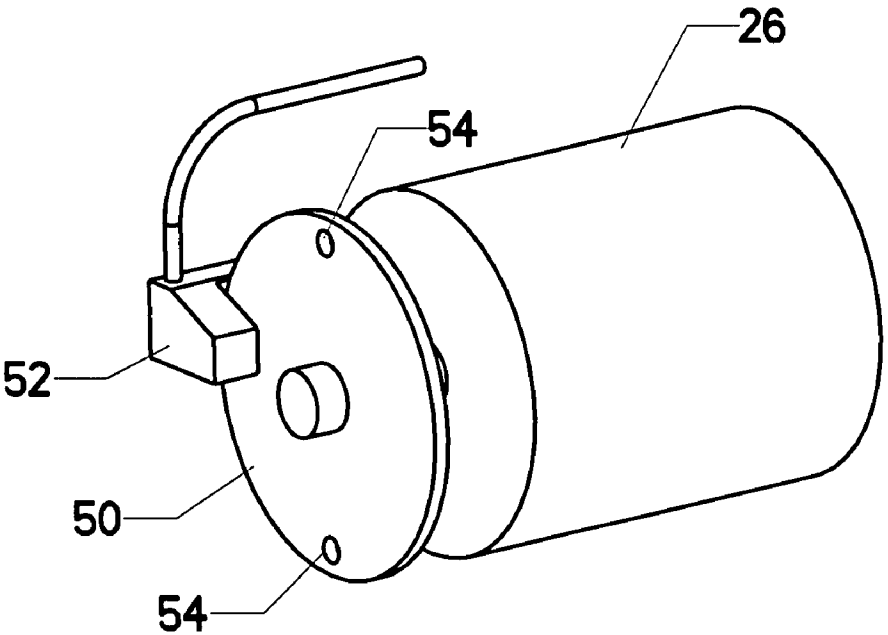
FIG. 8 (PRIOR ART)
FIG. 8 is a perspective view, showing the addition of an optical position and velocity sensor to a motor.

There are several ways to monitor an electric motor. FIG. 8 shows the addition of a sensing disk 50, which spins with the output shaft of motor 26. Sensing disk 50 has one or more trigger holes 54 spaced around its perimeter. Opto coupler 52 is positioned over a portion of the disk, much like a disk brake caliper over a brake rotor. The opto coupler includes a light source shining toward a light receiving switch. The light receiving switch turns "on" when it "sees" the light. The light is ordinarily blocked by the sensing disk. However, whenever a trigger hole rotates past the light receiving switch is hit by a pulse of light and generates a corresponding electrical signal. Thus, the arrangement shown in FIG. 8 can create a pulsed synchronization signal. The sensing disk can incorporate as many trigger holes as are desired.

Figure 9:
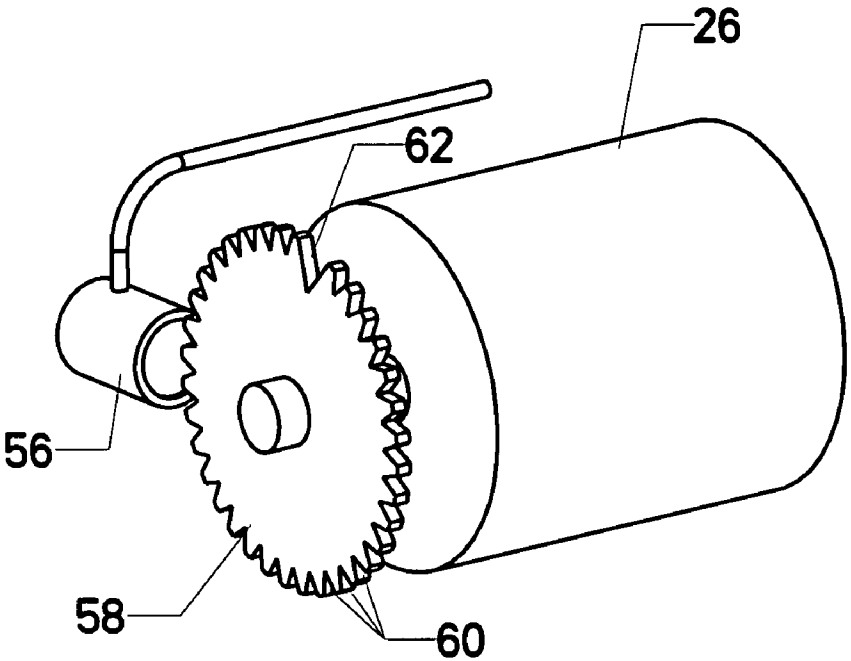
FIG. 9 (PRIOR ART)
FIG. 9 is a perspective view, showing the addition of a magnetic position and velocity sensor to a motor.

Those skilled in the art will know that there are many similar types of rotary position and velocity sensors, often called "rotary encoders." FIG. 9 shows another type. Magnetic disk 58 includes a series of spaced notches 60 around its perimeter. A larger zero notch 62 may also be included. Hall effect sensor 56 is directed toward magnetic disk 58, which is made of ferromagnetic material. The Hall effect sensor senses the passage of each notch. It can also sense the passage of the zero notch as a larger fluctuation. It therefore creates a pulsed synchronization signal.

Simpler speed and acceleration values can obtained by sensing the back EMF of the electric driving motor itself. This technique is well known in the field of electric motor control and is discussed in some detail in the incorporated patents. Back EMF sensing may be sufficient to provide synchronized sounds for model diesel engines.

Figure 10:
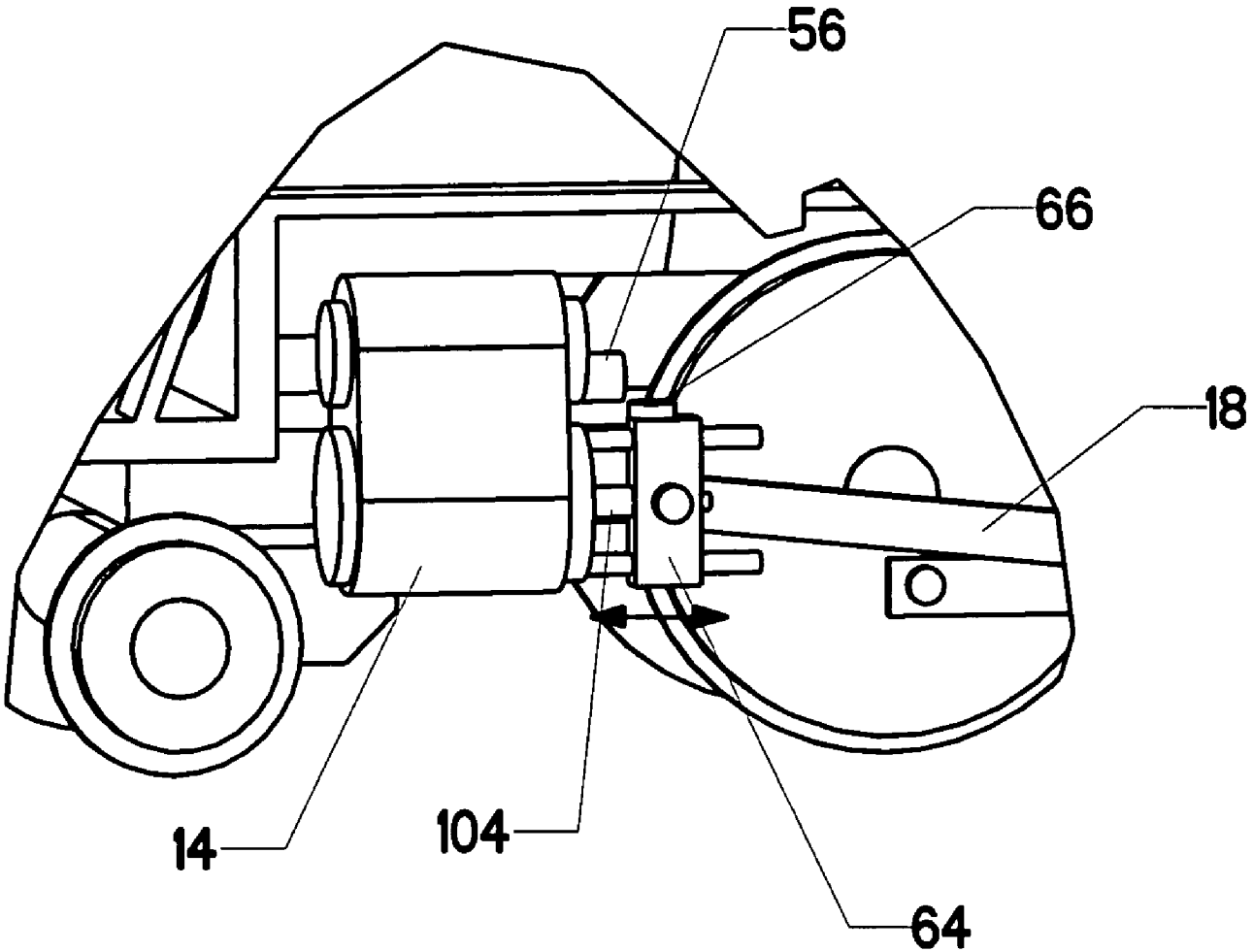
FIG. 10 is a perspective view, showing the addition of a magnetic position sensor to the piston of a model steam engine.

It may be desirable to provide an embodiment which can be retrofitted to older model trains. It is often impractical to modify the axles or motors of such trains. However, a simple switching mechanism may be easily applied. FIG. 10 shows a detailed view of piston 14 in model steam locomotive 10. Cross head 64 reciprocates toward and away from piston 14, along the axis of piston rod 104. One can place a small Hall effect sensor 56 on a stationary portion of the model locomotive proximate the piston. A magnet 66 can then be placed on cross head 64 (or other suitable moving component). The Hall effect sensor will then create a signal pulse every time the cross head comes near.

The reader will thereby appreciate that it is possible to accurately sense the position and velocity of a variety of moving components in a model train. For a model steam locomotive, it is logical to sense the position and speed of the steam pistons and associated linkages. For a model diesel locomotive, it may only be necessary to sense the model's acceleration and velocity as a whole.

Figure 11:
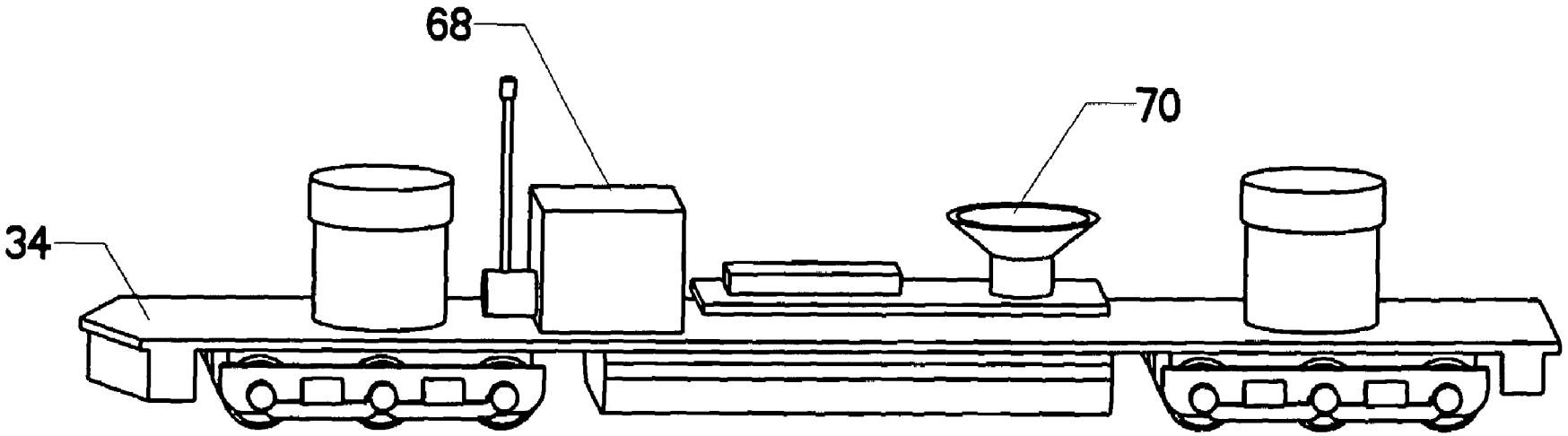
FIG. 11 is an elevation view, showing the addition of an RF transmitter to a model diesel locomotive.

Once the timing signal is obtained, the present invention contemplates exporting the signal to an external receiver/amplifier. FIG. 11 shows an elevation view of chassis 34 with some associated hardware. RF transmitter 68 is added. It transmits the synchronization signal via radio waves. Relatively low power is used, but the transmission strength is sufficient to cover the model train's area of operation. A 27 MHz transmitter of modest output has been found to be sufficient.

Chassis 34 may also include a small speaker labeled in the view as high frequency speaker 70. The size of this device is limited by the size of the model train, so it is typically quite small. It can be used to play train sounds corresponding to the model train's current state (accelerating under load, braking, etc.). In order to do this, the model train often includes memory means and an on-board processor. The on-board processor senses the state of the model train and retrieves the appropriate sound from the memory means, then plays it on high frequency speaker 70.

Of course, as mentioned in the introductory section, the on-board speaker is incapable of accurately projecting many realistic train noises. Real trains produce many low frequency noises, such as the bass rumbling of a diesel engine or the deep "chuff" of a steam train starting a load. The reproduction of such sounds requires a larger speaker.

Figure 12:
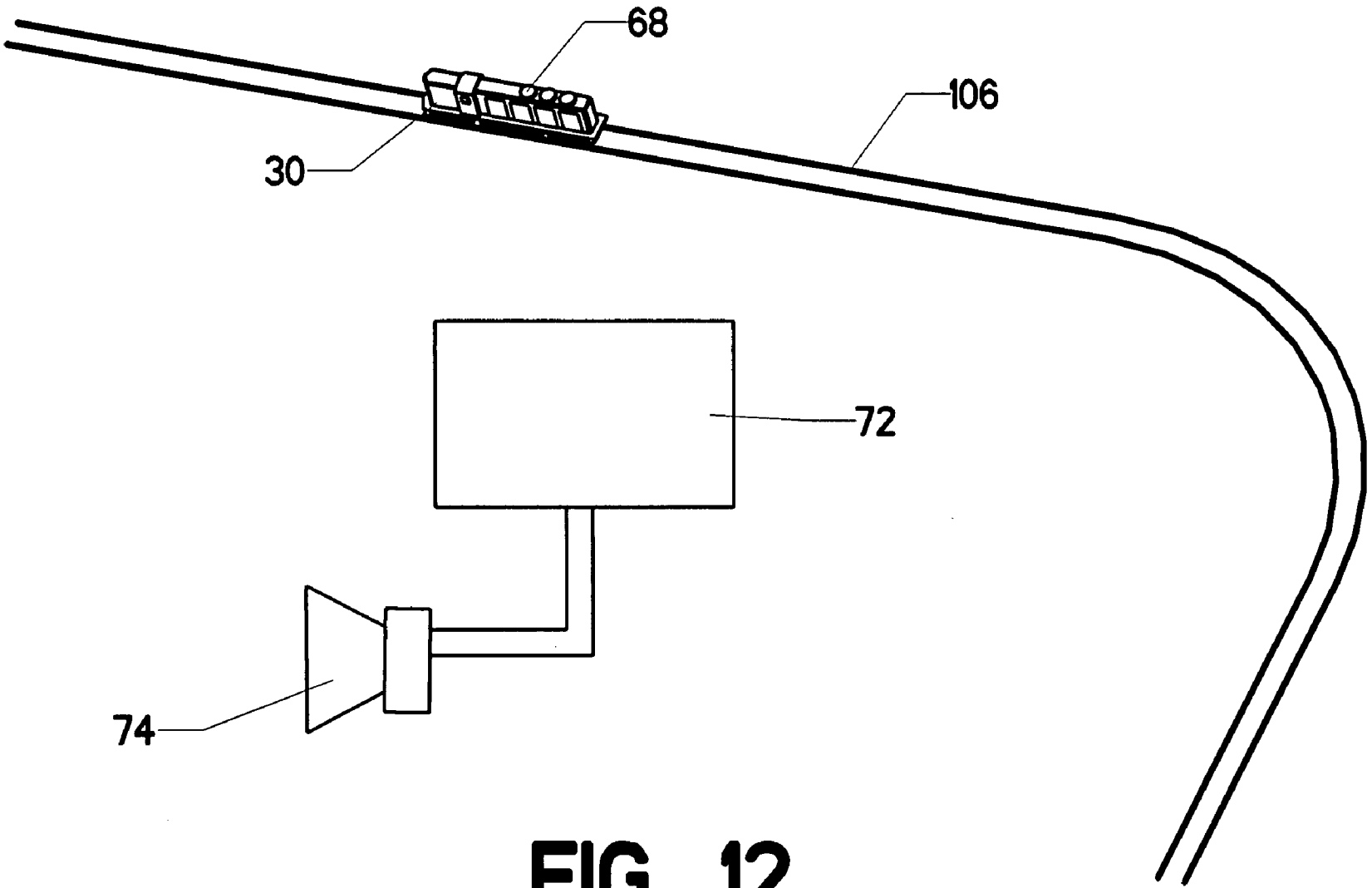
FIG. 12 is a schematic view, showing the external receiver/amplifier.

Referring now to FIG. 12, the basic operation of the invention may be understood. Model diesel locomotive 30 moves along various tracks in a track "layout." Tracks 106 are represented schematically in FIG. 12. RF transmitter 68 transmits a synchronized radio signal which is received by receiver/amplifier 72 (The term "synchronized" is used to indicate that the signal is synchronized with the motion of the model locomotive or a component thereof. The signal may be a simple timing pulse or it may be an actual sound signal fed in synchronization with the train's movements).

Receiver/amplifier 72 is located separately and is preferably fixed. It processes the synchronized signal and ultimately emits appropriate synchronized train noises on a sub-woofer 74. Sub-woofer 74 is a relatively large speaker which is capable of producing low-frequency tones. It can preferably also produce significant amplitudes, so that powerful noises (such as the aforementioned diesel rumble) can be made to sound powerful.

EXAMPLE ONE

Figure 13:
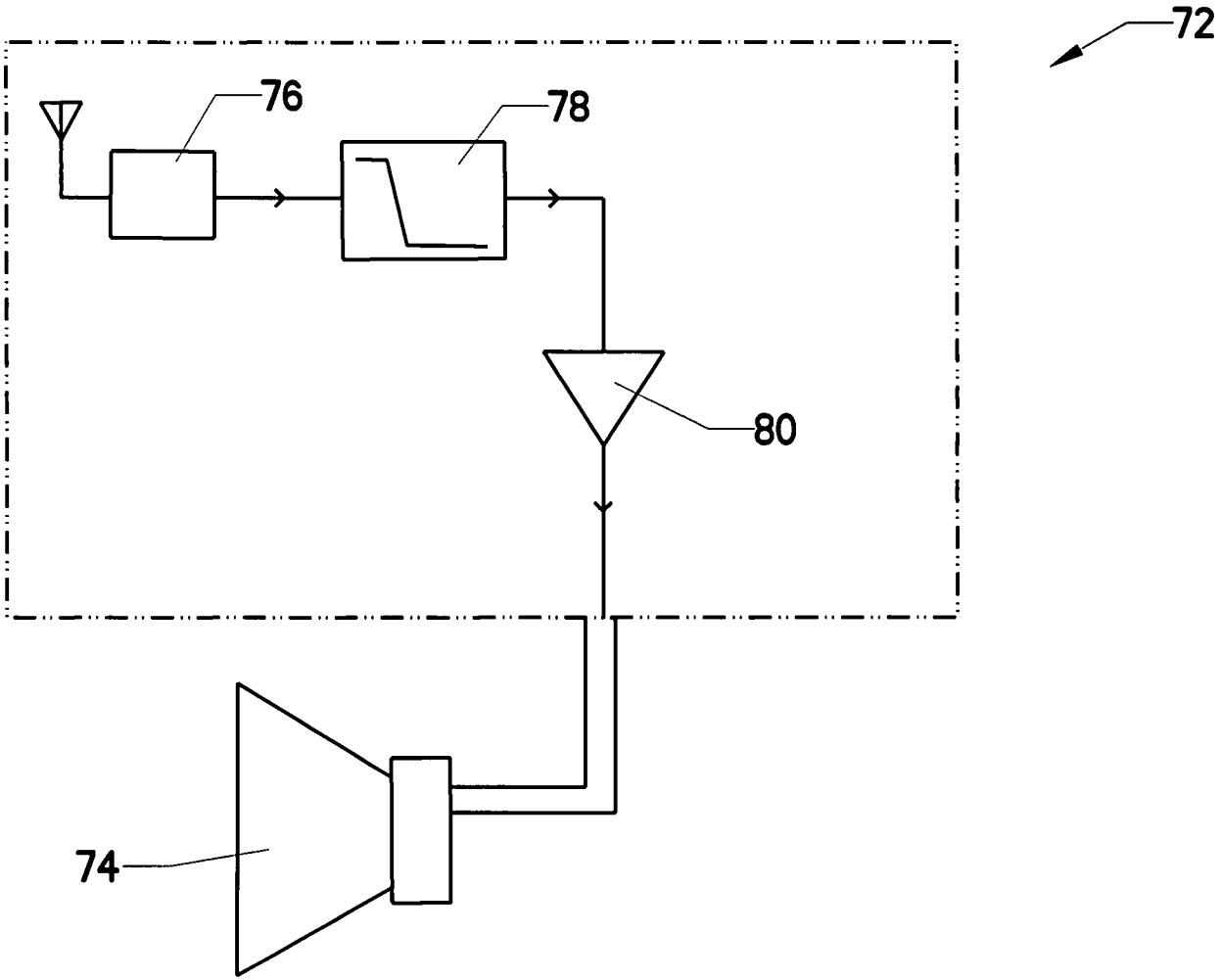
FIG. 13 is a schematic view, showing more detail of the external receiver/amplifier.

The synchronized radio signal can assume many forms. The receiver/amplifier can likewise assume many forms. It is helpful to discuss some of these forms. FIG. 13 shows an example which assumes that the appropriate train sounds are generated on board the model locomotive and transmitted—in their entirety—by RF transmitter 68. This embodiment assumes that they are transmitted as an analog signal.

If the model diesel locomotive is accelerating under a load, then the on board sensors will measure this fact and the on board sound generation hardware and software will create deep rumbling sounds for the diesel engine. The sound signal is fed to high frequency speaker 70 and played aboard the train (though the recreation of sound will be poor). However, the sound signal is also fed to RF transmitter 68 and broadcast as radio waves.

Receiver 76 receives the synchronized radio signal and converts it to an analog audible frequency signal (typically through demodulation and other known radio techniques beyond the scope of this disclosure). The signal then passes through low-pass filter 78, which removes the higher frequency components.

The signal next passes through power amplifier 80, which provides a suitable amplitude boost before transmitting the signal to sub-woofer 74. The sub-woofer then projects the signal as sound waves.

Returning now to FIG. 11, the reader will recall that this example assumes that the train sounds are generated aboard the model locomotive. The sound signal is preferably fed to high frequency speaker 70 at the same time it is fed to RF transmitter 68. The result is that the relatively high frequency sounds are projected by high frequency speaker 70 while relatively low frequency sounds are generated remotely by sub-woofer 74.

The radio transmission and processing delays are not perceptible. Thus, the high frequency and low frequency components are perceived simultaneously. The result is much more realistic than using the small speaker on board the model train by itself. As an example, the squealing sounds of braking could be emitted by the speaker aboard the train while the remotely located sub-woofer provides a suitable rumbling sound.

Those skilled in the art will know that the arrangement shown in FIGS. 12 and 13 could be altered without changing the substance of the design. As one example, low-pass filter 78 could be placed on board the model train to filter out the high frequency signals before they are sent to RF transmitter 78.

The system described can be implemented using digital or analog processing. Analog processing offers the advantage of simplicity. And, synchronized signals from multiple trains can be simultaneously fed to receiver/amplifier 72 and played over a single sub-woofer 74.

EXAMPLE TWO

Older model trains do not have on board sound generating hardware. For these types it may be desired to retrofit a synchronization sensor, such as shown in FIG. 10. An RF transmitter 68 would also be installed. However, the synchronized radio signal would just be a pulse indicating when the selected moving component on the model locomotive has reached a certain position. The example of FIG. 10 is suitable, as that sensor detects a certain position for the cross head (which represents an end stage of a piston stroke for an actual steam engine). The pulsed signal could be transmitted via RF transmitter 68.

Figure 14:
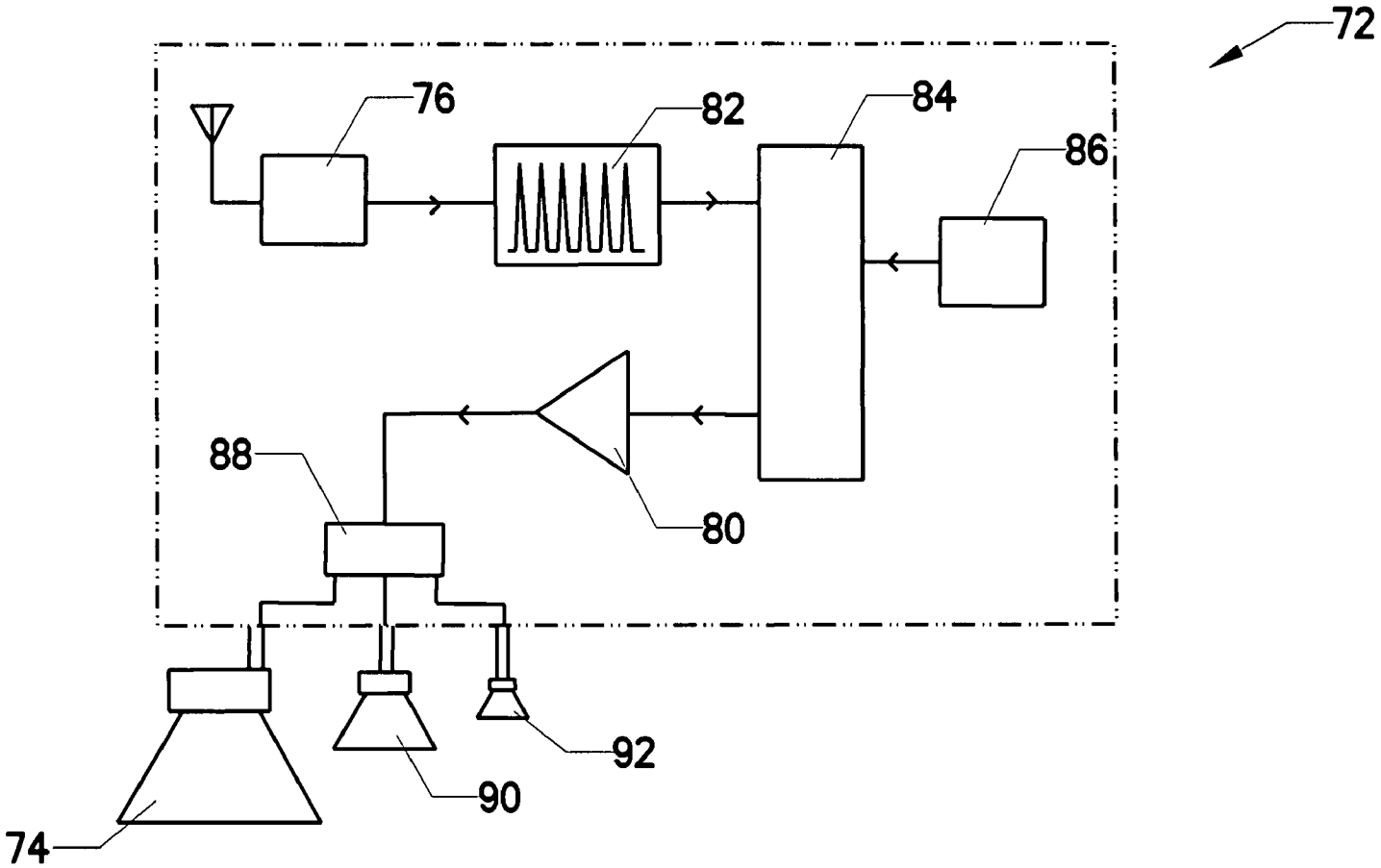
FIG. 14 is a schematic view, showing the addition of a frequency splitter.

Of course, the receiver/amplifier will be required to perform additional functions since the pulsed signal is not an actual sound signal but rather just a timing pules. FIG. 14 shows an altered version of receiver/amplifier 72 configured for this example. Receiver 76 receives timing signal 82 and feeds it into processor 84. Processor 84 runs software and can be configured to assign different sounds to the timing signal. In this example, the user will have configured it to assign the sounds of a steam engine. The configuration can be accomplished by setting switches, providing a digital computer interface, etc.

Processor 84 is in communication with sound memory 86. It retrieves suitable steam train sounds from sound memory 86 and synchronizes these with timing signal 82. The synchronized train sounds are then fed into power amp 80.

For this example, all the sounds associated with the train are external to the train. Thus, it may be preferable to provide a frequency splitter 88 feeding the sound signal into a variety of speakers, including sub-woofer 74, mid-range speaker 90 and tweeter 92.

This embodiment can be equipped with multiple channels operating on multiple frequencies. Thus, a model steam engine could be assigned 26.5 MHz and a model diesel engine could be assigned 27.5 MHz. Two appropriately tuned receivers would receive the two timing signals and feed them into the processor. Processor 84 would then retrieve and assign the appropriate train sounds to the appropriate model train.

EXAMPLE THREE

Other effects can be synchronized with the sound generation as well. Model steam engines have used smoke generators for many years. Those skilled in the art will know that an actual steam train rhythmically puffs smoke rather than blowing it continuously. The advantages of synchronized sound generation can be applied to smoke effects as well. The previously incorporated U.S. Pat. No. 6,485,347 to Grubba provides a good explanation of smoke generation.

Figure 15:
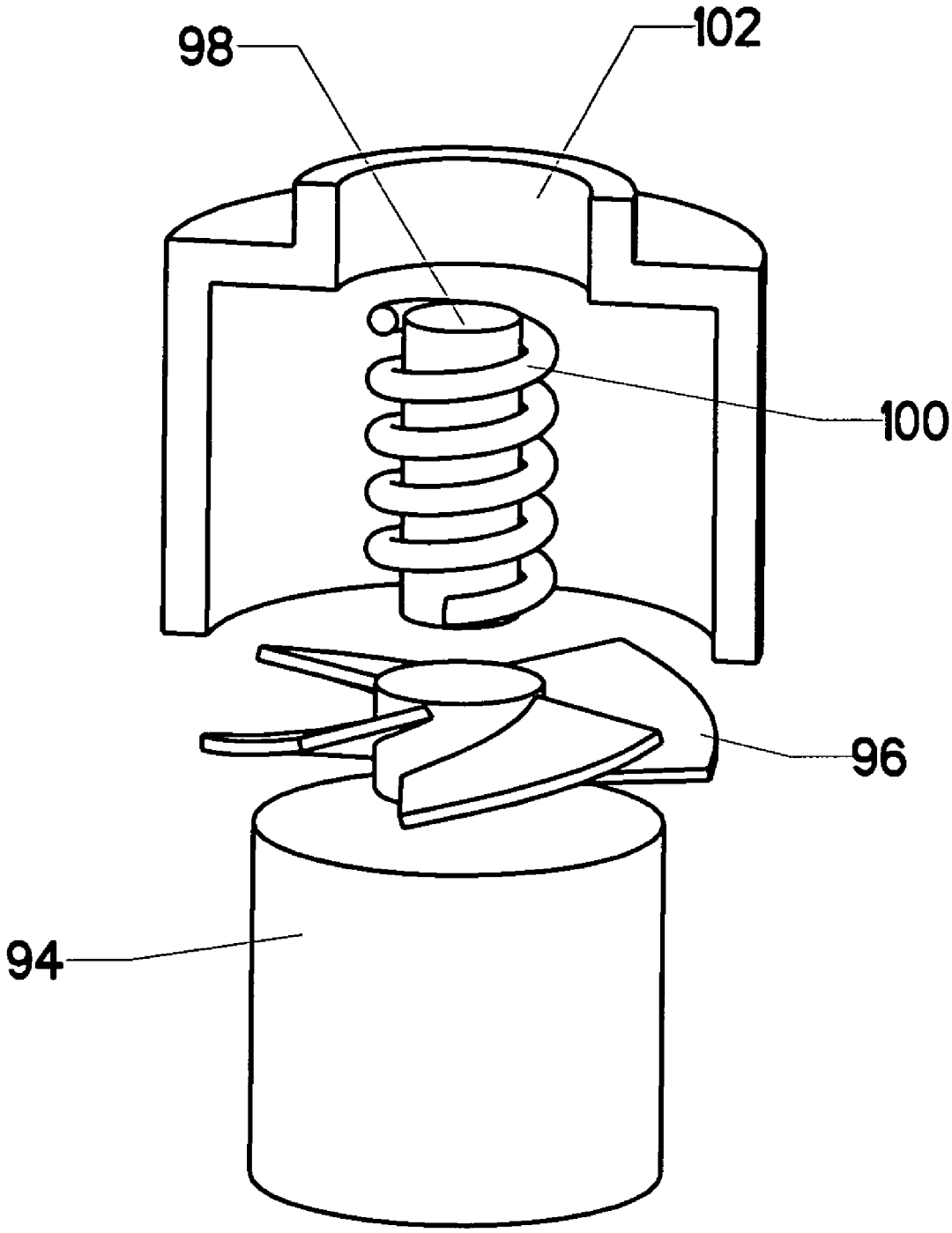
FIG. 15 is a schematic view, showing a smoke generator.

FIG. 15 shows a simplified depiction of a smoke generator in which fan 96 blows air past an oil-soaked wick 98 which is heated by heating element 100. The smoke produced exits through exhaust 102 (which is positioned to mimic the smoke of an actual steam train).

If fan motor 94 is rapidly switched on and off (or even reversed), then a puffing effect will be created. The previously described timing signal can be used to control the motion of motor 94. The Hall effect sensor shown in FIG. 10 is useful for generating the desired timing signal. The timing signal can then be used to switch the motor using an appropriate power transistor or relay. The result is a puffing smoke effect which can be synchronized with the motion of the cross head on the steam engine and also with the sound generated.

Although the preceding descriptions contain significant detail they should not be viewed as limiting the invention but rather as providing examples of the preferred embodiments of the invention. Many variations are possible. As one example, although a radio frequency transmitter has been discussed, other types of transmitters could be used as well. The model locomotive will be traveling over a set of conductive rails and will be in electrical contact with these rails. Thus, the transmitter could be configured to transmit the signal over the rails. The receiver would then likewise be configured to receive the signal from the rails. Accordingly, the scope of the invention should be determined by the following claims, rather than the examples given.

I claim:

1. A system for generating synchronized effects in a model train having a selected moving component, comprising:

a. at least one sensor located on said model train for sensing the position of said selected moving component and generating a synchronized signal corresponding to said position of said selected moving component;

b. memory means located on said model train for storing train sounds;

c. a processor located on said model train for retrieving said train sounds from said memory means and playing them in synchronization with said synchronized signal to create a synchronized train sound signal;

d. a radio transmitter located on said model train for transmitting said synchronized train sound signal;

e. a sound generator located separately from said model train, wherein said sound generator includes, i. a receiver for receiving said synchronized train sound signal from said model train, ii. a first speaker for projecting said synchronized train sound signal;

f. a second speaker located on board said model train;

g. a filtering system for separating said synchronized train sound signal into a first component containing higher frequencies and a second component containing lower frequencies;

h. wherein said first component is played over said speaker located on board said model train; and i. wherein said second component is played over said first speaker.

2. A system for generating synchronized effects in a model train as recited in claim 1, wherein:

a. said model train is powered by an electric motor; and b. said at least one sensor is a rotary encoder capable of sensing the angular position and angular velocity of said electric motor.

3. A system for generating synchronized effects in a model train as recited in claim 1, wherein:

a. said model train includes a plurality of driving wheels;

b. said model train includes a set of linkages connected to and moving in synchronization with said driving wheels; and c. said at least one sensor is a proximity sensor capable of sensing the position of said set of linkages.

4. A system for generating synchronized effects in a model train as recited in claim 1, wherein:

a. said model train includes two wheels linked together by an axle; and b. said at least one sensor comprises a cam located on said axle which actuates a contact switch as said axle rotates.

5. A system for generating synchronized effects in a model train as recited in claim 1, wherein:

a. said model train includes two wheels linked together by an axle; and b. said at least one sensor comprises an insulated portion on said axle which breaks an electrical circuit as said axle rotates.

6. A system for generating synchronized effects in a model train as recited in claim 1, wherein:

a. said model train includes a smoke generator with a fan for expelling smoke; and b. said synchronized signal is used to control said fan so that said smoke is expelled in synchronization with said synchronized signal.

7. A system for generating synchronized effects in a model train having a selected moving component as recited in claim 1, wherein said transmitter is a radio transmitter.

8. A system for generating synchronized effects in a model train having a selected moving component as recited in claim 1, wherein:

a. said model train is traveling along a plurality of rails;

b. said transmitter transmits said synchronized train sound signal to said plurality of rails; and c. said receiver receives said synchronized sound signal from said plurality of rails.

9. A system for generating synchronized effects in a model train having a selected moving component, comprising:

a. at least one sensor located on said model train for sensing the position of said selected moving component and generating a synchronizing signal corresponding to said position of said selected moving component;

b. memory means located on said model train for storing train sounds;

c. a processor located on said model train for retrieving said train sounds from said memory means and playing them in synchronization with said synchronizing signal to create a synchronized train sound signal, wherein said synchronized train sound signal contains low frequency components and high frequency components;

d. a first speaker located on said model train wherein said first speaker plays said high frequency components;

e. a radio frequency transmitter located on said model train for transmitting said synchronized train sound signal;

f. a sound generator located separately from said model train, wherein said sound generator includes, i. a receiver for receiving said synchronized train sound signal from said model train, ii. a second speaker for projecting said synchronized train sounds;

g. a filtering system for separating said synchronized train sound signal into a first component containing higher frequencies and a second component containing lower frequencies;

h. wherein said first component is played over said first speaker located on board said model train; and i. wherein said second component is played over said second speaker.

10. A system for generating synchronized effects in a model train as recited in claim 9, wherein said sound generator is configured to primarily project said second component of said synchronized train sound signal.

11. A system for generating synchronized effects in a model train as recited in claim 9, wherein:

a. said model train is powered by an electric motor; and b. said at least one sensor is a rotary encoder capable of sensing the angular position and angular velocity of said electric motor.

12. A system for generating synchronized effects in a model train as recited in claim 9, wherein:

a. said model train includes a plurality of driving wheels;

b. said model train includes a set of linkages connected to and moving in synchronization with said driving wheels; and c. said at least one sensor is a proximity sensor capable of sensing the position of said set of linkages.

13. A system for generating synchronized effects in a model train as recited in claim 9, wherein:

a. said model train includes two wheels linked together by an axle; and b. said at least one sensor comprises a cam located on said axle which actuates a contact switch as said axle rotates.

14. A system for generating synchronized effects in a model train as recited in claim 9, wherein:

a. said model train includes two wheels linked together by an axle; and b. said at least one sensor comprises an insulated portion on said axle which breaks an electrical circuit as said axle rotates.

15. A system for generating synchronized effects in a model train as recited in claim 9, wherein:

a. said model train includes a smoke generator with a fan for expelling smoke; and b. said synchronized signal is used to control said fan so that said smoke is expelled in synchronization with said synchronized signal.

* * * * *